United States Patent [19]

Cohen

[11] Patent Number: 5,007,586

[45] Date of Patent: Apr. 16, 1991

[54] ROTARY SPRINKLERS

[75] Inventor: Amir Cohen, Tuvalium, Israel

[73] Assignees: Agroteam Consultants Ltd, Timrat; Plastro-Gvat, Kibbutz Gvat, both of Israel

[21] Appl. No.: 400,246

[22] Filed: Aug. 29, 1989

Related U.S. Application Data

[63] Continuation-in-part of Ser. No. 174,732, Mar. 29, 1988, Pat. No. 4,886,211.

[30] Foreign Application Priority Data

May 13, 1987 [IL] Israel ..... 82513
Jul. 21, 1989 [IL] Israel ..... 91062

[51] Int. Cl.[5] ..... B05B 3/08

[52] U.S. Cl. ..... 239/222.17; 239/233; 239/246; 239/252; 239/506

[58] Field of Search ..... 239/222.17, 222.21, 239/233, 246, 252, 259, 381, 504, 506; 188/296, 322.5

[56] References Cited

U.S. PATENT DOCUMENTS

| | | | |
|---|---|---|---|
| 1,322,466 | 11/1919 | Partridge | 239/222.17 |
| 1,993,011 | 3/1935 | Lindberg | 239/222.17 |
| 2,488,234 | 11/1949 | Perry | 239/222.17 |
| 4,121,769 | 10/1978 | Drori | 239/222.17 |
| 4,356,972 | 11/1982 | Vikre | 239/222.17 |
| 4,440,345 | 4/1984 | Figwer et al. | 239/252 |
| 4,498,628 | 2/1985 | Tucker | 239/381 |
| 4,560,108 | 12/1985 | Rubinstein | 239/222.17 |
| 4,583,689 | 4/1986 | Rosenberg | 239/381 |
| 4,660,766 | 4/1987 | Nelson et al. | 239/222.17 |
| 4,796,811 | 1/1989 | Davisson | 239/222.17 |

FOREIGN PATENT DOCUMENTS

| | | | |
|---|---|---|---|
| 495586 | 9/1950 | Belgium | 239/222.17 |
| 934448 | 5/1948 | France | 239/222.17 |
| 476072 | 11/1952 | Italy | 239/252 |

*Primary Examiner*—Andres Kashnikow
*Assistant Examiner*—Michael J. Forman
*Attorney, Agent, or Firm*—Benjamin J. Barish

[57] ABSTRACT

A rotary sprinkler comprises a nozzle outputting a jet axially thereof; a rotor rotatably mounted with respect to the nozzle in alignment with the axial jet and having a surface formation impinged by the axial jet to deflect the jet laterally of the nozzle and to rotate the rotor; and a retarding device having a first surface rotatable with the rotor with respect to the nozzle, a second surface non-rotatable with respect to the nozzle, and a viscous liquid between the first and second surfaces; characterized in that the first surface of the retarding device is a cavity formed in a surface of the rotor opposite to that having the surface formation impinged by the axial jet, and that the second surface of the retarding device is carried by a pin non-rotatably mounted with respect to the nozzle and disposed within the cavity.

20 Claims, 3 Drawing Sheets

FIG. 8
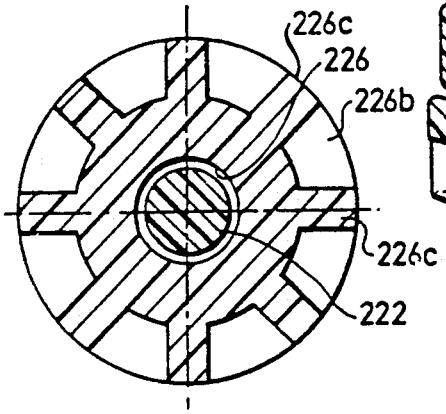
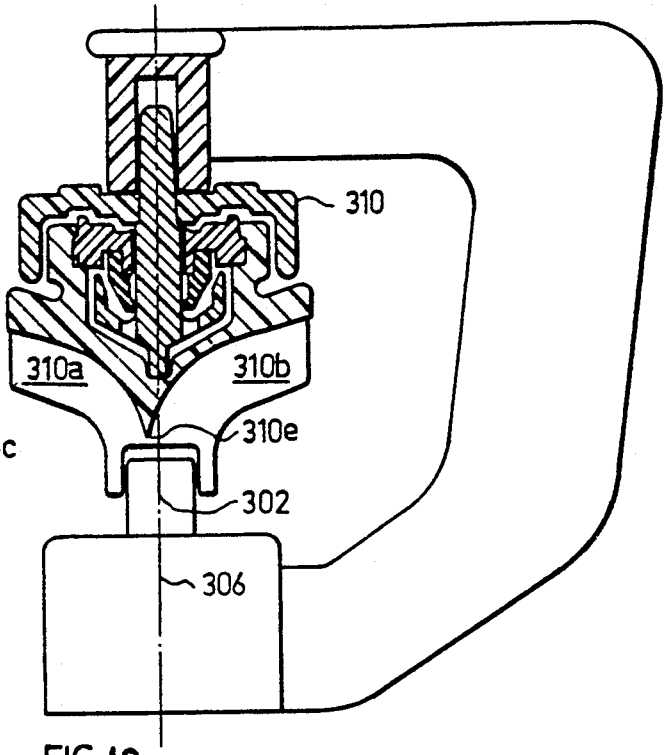
FIG. 10
FIG. 9
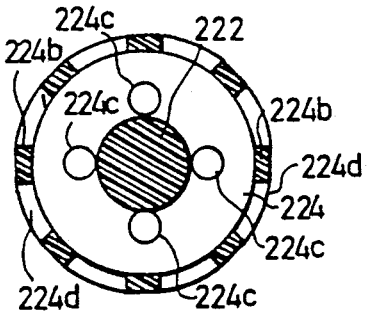
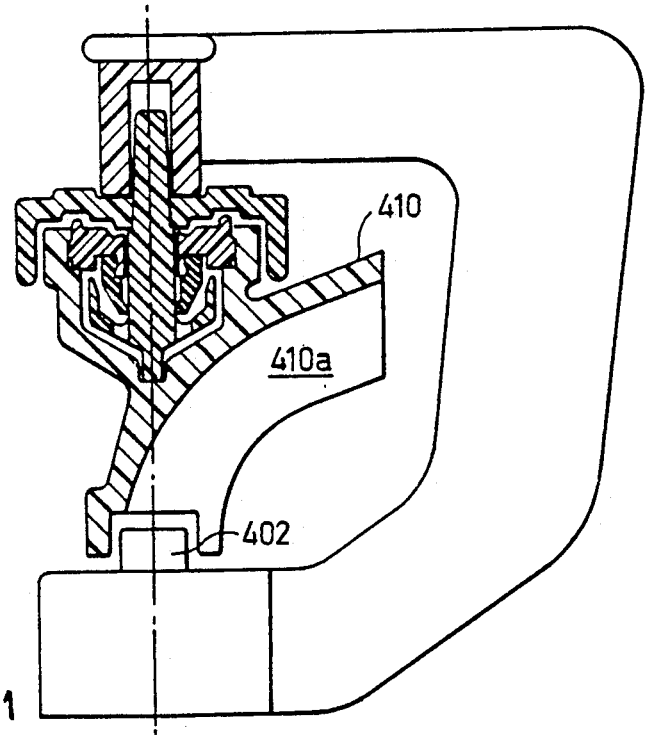
FIG. 11

ROTARY SPRINKLERS

RELATED APPLICATION

The present application is a continuation-in-part of U.S. patent application Ser. No. 07/174,732 filed Mar. 29, 1988, new U.S. Pat. No. 4,886,211, issued Dec. 12, 1989, and assigned to the same assignees as the present application.

BACKGROUND OF THE INVENTION

As described in patent application Ser. No. 07/174,732, a common form of rotary sprinkler includes a nozzle outputting a jet axially of the nozzle, and a rotor rotatably mounted with respect to the nozzle in alignment with the axial jet and having a surface formation impinged by the axial jet and effective to deflect the jet laterally of the nozzle and to rotate the rotor. Such rotary sprinklers, however, have a tendency to rotate at a high velocity, which decreases the effective range of the sprinkler. For this reason, such sprinklers have been provided with a retarding device having a first surface rotatable with the rotor with respect to the nozzle, a second surface non-rotatable with respect to the nozzle, and a viscous liquid between the two surfaces for retarding the rotation of the rotor. Sprinklers equipped with such retarding devices are described in U.S. Pat. Nos. 4,660,766 and 4,796,811. In the sprinklers described in the above patents, the surface rotatable with the rotor with respect to the nozzle is in the form of a pin secured to the rotor, and the surface non-rotatable with respect to the nozzle is in the form of a cavity formed in a part of the rotary sprinkler fixed to the nozzle and containing the viscous liquid.

OBJECTS AND SUMMARY OF THE PRESENT INVENTION

An object of the present invention is to provide a rotary sprinkler of the foregoing type, but including an improved retarding device construction having advantages in several respects as will be described more particularly below.

According to the present invention, there is provided a rotary sprinkler of the type described above and comprising a nozzle outputting a jet axially thereof; a rotor rotatably mounted with respect to the nozzle in alignment with the axial jet and having a surface formation impinged by the axial jet to deflect the jet laterally of the nozzle and to rotate the rotor; and a retarding device having a first surface rotatable with the rotor with respect to the nozzle, a second surface non-rotatable with respect to the nozzle, and a viscous liquid between the first and second surfaces. The present invention, however, is characterized in that the first (rotatable) surface of the retarding device is a cavity formed in a surface of the rotor opposite to that having the surface formation impinged by the axial jet, and that the second (non-rotatable) surface of the retarding device is carried by a pin non-rotatably mounted with respect to the nozzle and disposed within the cavity. The cavity in the rotor is covered by a cover removably attached to the rotor and penetrated by the pin centrally of the cover. In one embodiment described below, the cover is fixed to the pin and rotatably receives the rotor; and in other described embodiments, the cover is fixed to the rotor and rotatably receives the pin.

An important advantage provided by the present invention is that it enables sprinklers to be constructed more compactly than the previously-known sprinklers of this type Thus, in the previously-known sprinklers (as described for example in the two above-cited patents), the cavity of the retarding device is formed in the part fixed to the nozzle, such as in the leg of a bridge fixed to the nozzle. This requires that part (e.g., the leg of the bridge) to be of sufficient thickness to accommodate the required height of the socket. The present invention, however, exploits the fact the rotor must be of a certain minimum height in order to perform its deflecting function, and utilizes this required height of the rotor to form the socket for receiving the pin of the retarding device, thereby obviating the need to thicken the mounting member fixed to the nozzle for rotatably mounting the rotor. In fact, it has been found that a rotary sprinkler constructed in accordance with the foregoing features of the present invention enables the overall height of the sprinkler to be reduced by approximately 50% as compared to rotary sprinklers of the previously-known type for the same flow rate.

According to further features in preferred embodiments of the invention described below, the cavity includes a substantially cylindrical section, and the pin includes a skirt disposed within the substantially cylindrical section of the cavity and immersed in the viscous liquid in the cavity. The skirt is formed with an inner section fixed to the pin and extending generally radially with respect thereto, and an outer annular section extending generally axially with respect to the pin. Further, the inner section of the skirt is formed with a plurality of openings to permit the free flow of the viscous liquid therethrough. Preferably, one surface of the cavity is of conical configuration, and the inner section of the skirt is adjacent to, and of the same conical configuration as, the conical surface of the cavity. Such features further enable the sprinkler to be constructed very compactly and still provide a relatively large retarding effect.

According to still further features included in preferred embodiments of the invention described below, a seal is carried by the cover and includes an annular sealing surface in contact with the pin to seal the cavity. The annular surface of the seal is located so as to be continuously immersed in the viscous liquid in the cavity. Such a construction reduces friction and prevents the seal from drying out, thereby not only more effectively sealing the cavity from external dirt, but also extending the useful life of the seal.

According to still further preferred features in the embodiments of the invention described below, the cover includes a plurality of radially-extending ribs attachable to the rotor with a snap-fit, the ribs being angularly spaced from each other to define venting passageways therethrough. Such a construction not only permits air or an excess of viscous liquid to pass to the atmosphere, but also simplifies the initial filling of the cavity with the viscous liquid as well as subsequent refilling with make-up viscous liquid.

According to an additional feature in the described preferred embodiments, the rotary sprinkler further includes a pin-mounting member fixed to the nozzle, the pin-mounting member being formed with a socket for receiving the pin. Both the latter socket and the portion of the pin received therein are of non-circular cross-section so as to prevent rotation of the pin with respect to the nozzle, but to permit movement of the pin axially of the nozzle. Such a construction permits the rotor to move downwardly to close the nozzle opening when the sprinkler is not being used, thereby preventing dirt or insects from entering and clogging the nozzle opening.

Further features and advantages of the invention will be apparent from the description below.

BRIEF DESCRIPTION OF THE DRAWINGS

The invention is herein described, by way of example only, with reference to the accompanying drawings, wherein:

FIGS. 7, 8 and 9 are enlarged sectional views along lines VII—VII, VIII—VIII and IX—IX, respectively, in FIG. 6; and FIGS. 10 and 11 are longitudinal sectional views illustrating two additional rotary sprinklers constructed in accordance with the present invention.

DESCRIPTION OF PREFERRED EMBODIMENTS

The Embodiment of FIGS. 1-4*b*

Figure 1:
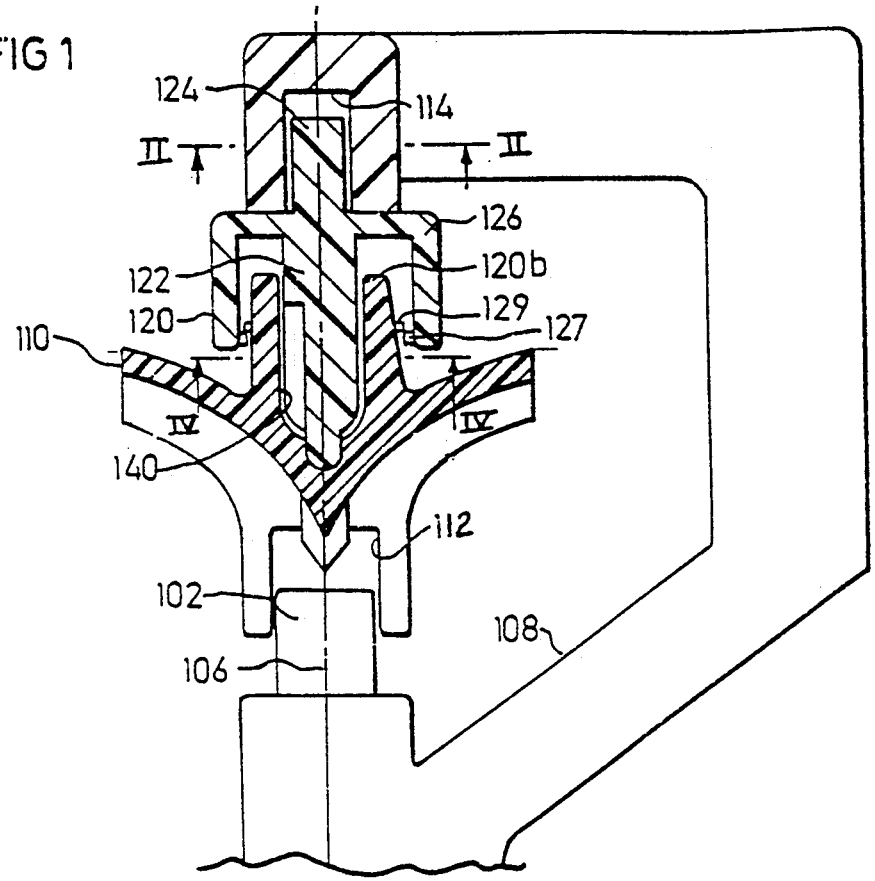
FIG. 1 is a side elevational view, partly in section, illustrating one form of rotary sprinkler constructed in accordance with the present invention.

FIG. 1 illustrates a rotary sprinkler, including a nozzle 102 of outer cylindrical configuration producing a jet parallel to the axis 106 of the nozzle; a bridge 108 secured to the nozzle; and a rotor 110 formed with a socket 112 rotatably receiving nozzle 102 and thereby floatingly mounting the rotor on the nozzle for both rotatable and axial movements with respect to the nozzle. The upper horizontal leg of bridge 108 is formed with a socket 114 in alignment with axis 106 of the nozzle; in addition, rotor 110 is formed with a socket or cavity 120 rotatable with respect to a pin 122 received in the rotor cavity 120. This cavity is filled with a viscous liquid 140 which serves to retard the rotation of the rotor with respect to the pin. Pin 122 is formed at its opposite end with a head 124 non-rotatably received within the bridge socket 114.

Figure 2:
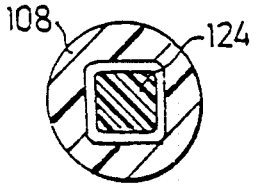
FIG. 2 is a sectional view along lines II-II of FIG. 1.

Rotor cavity 120 is coaxial to axis 106 of nozzle 102 and bridge socket 114. As shown in FIG. 2, both the bridge socket 114 and head 124 of pin 122 are of generally square cross-section. This construction permits pin 122 to move axially, but not to rotate, with respect to bridge socket 114 and nozzle 102.

Figure 3A:
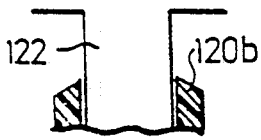
FIG. 3*a* is a fragmentary view illustrating the structure at the upper end of the rotor socket in FIG. 1.
Figure 3B:
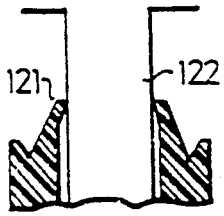
FIGS. 3*b* and 3*c* are fragmentary views illustrating variations in the construction shown in FIG. 3*a;*
Figure 3C:
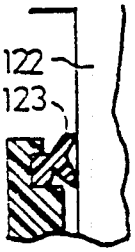

FIG. 3*a* illustrates the upper end 120*b* of cavity 120, wherein it will be seen that this upper end is closely spaced to pin 122 so as to prevent leakage of the high viscosity fluid from the cavity. FIG. 3*b* illustrates a variation wherein the upper end of the rotor cavity 120 is formed with a lip 121 bearing against pin 122 so as to more effectively seal the fluid within the socket; and FIG. 3*c* illustrates a further variation wherein the upper end of the cavity is provided with a sealing ring 123 which prevents leakage of the high viscosity fluid from the cavity during the operation of the sprinkler.

Pin 122 is formed with a cover 126 covering the upper end of the rotor cavity 120. The cover 126 is removably attached to the rotor 110 together with the pin 122, which pin penetrates the cover centrally of the cover. If desired, cover 126 may be formed with an annular rib 127 at its outer end snappable over an annular rib 129 formed in the rotor socket 120 so as to retain pin 122 attached to the rotor. However, this is not essential since the upper horizontal leg of bridge 108 formed with the bridge socket 114 will prevent the separation of the rotor and pin from the nozzle 102 during the operation of the sprinkler.

Figure 4A:
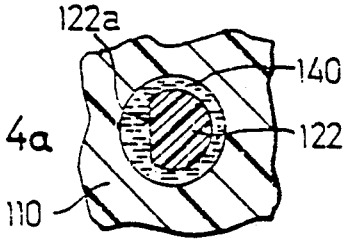
FIG. 4*a* is a sectional view along line IV—IV of FIG. 1.
Figure 4B:
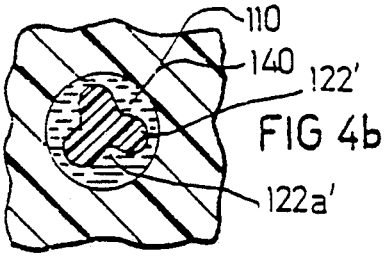
FIG. 4*b* illustrates a variation in the construction shown in FIG. 4*a*.

It will be seen that during the operation of the sprinkler illustrated in FIG. 1, the retarding of the rotation of the rotor will be effected by the highly-viscous fluid %40 between the axial pin 122 and rotor cavity 120. The lower end of pin 122, received within rotor cavity 120, is of non-cylindrical configuration. This increases the retarding effect produced by the high-viscosity fluid 140 within the cavity. FIG. 4*a* illustrates one construction of pin 122 for this purposes, wherein it will be seen that the pin includes a flat side 122*a*. FIG. 4*b* illustrates an alternative construction, wherein the pin 122' is formed with a plurality (three being illustrated) axially-extending recesses 122*a'* for increasing the retarding effect produced by the high-viscosity fluid 140.

The Embodiments of FIGS. 5-11

Figure 5:
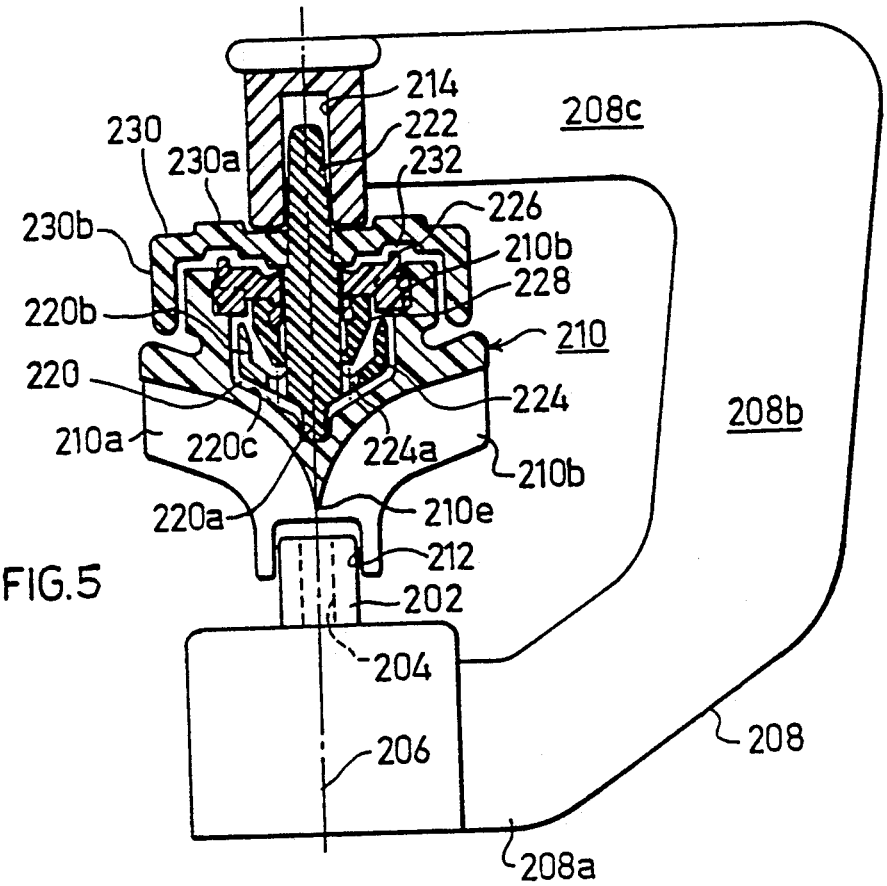
FIG. 5 is a longitudinal sectional view illustrating another form of rotary sprinkler constructed in accordance with the present invention.
Figure 6:
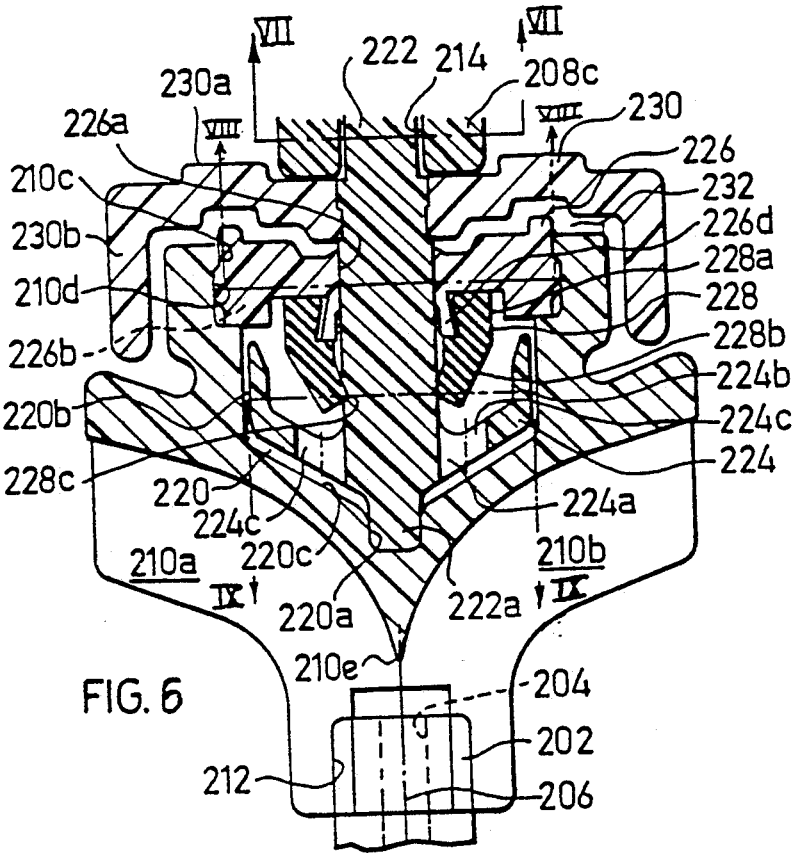
FIG. 6 is an enlarged fragmentary view of FIG. 5.

FIG. 5 illustrates a rotary sprinkler comprising a nozzle 202 of outer cylindrical configuration connectable to a source of pressurized water and formed with a through-going bore 204 for producing a jet parallel to the axis 206 of the nozzle. Nozzle 202 is generally mounted so that its axis 206 extends vertically.

The illustrated sprinkler further includes a bridge 208 having a lower horizontal leg 208*a* secured to nozzle 202, a vertical leg 208*b* laterally of the nozzle, and an upper horizontal leg 208*c* spaced above the nozzle. Bridge 208 is used for rotatably mounting a rotor, generally designated 210, in axial alignment with respect to nozzle 202. For this purpose, the lower end of rotor 210 is formed with a socket 212 rotatable with respect to nozzle 202, and bridge leg 208*c* is also formed with a socket 214 for rotatably mounting the rotor. The two sockets 212 and 214 are in alignment with each other and also with the axis 206 of the nozzle bore 204.

Socket 212 of rotor 210 floatingly mounts the rotor on nozzle 202, permitting the rotor to move axially, as well as rotatably, with respect to the nozzle. Thus, when the sprinkler is not operating, rotor 210 rests, by its own weight, against the upper face of nozzle 202 so as to close the nozzle bore 204 against the entry of insects, dirt or the like; and when the sprinkler is operating, the pressurized water discharged via bore 204 of the nozzle, raises the rotor 210 (as shown in FIG. 5), and rotates it about axis 206.

The underface of rotor 210 is formed with a pair of channels or grooves 210*a*, 210*b* of curved configuration each extending through an arc of approximately 90°, such that the lower end of each channel is aligned with the nozzle bore 204, and the upper end of each channel extends substantially horizontally, or with a slight upward inclination to the horizontal. The underface of rotor 210 thus receives the water jet exiting axially from nozzle 202 and deflects it laterally of the nozzle, to thereby rotate the rotor and also to form two streams of water laterally of the sprinkler.

The retarding device included in the rotary sprinkler illustrated in FIG. 5 comprises a cavity 220 formed in the surface of the rotor 210 opposite to that having the channel formations 210*a*, 210*b* impinged by the axial jet. The retarding device further includes a pin 222 non-rotatably coupled to bridge leg 208*c* fixed with respect to nozzle 206. The lower end of pin 222 carries a skirt 224. Both the pin and its skirt are received within cavity 220 formed in the rotor 210. The cavity 220 is closed by a cover 226, which cover also carries a seal 228 in sealing relationship with respect to pin 222. Cavity 220 is filled with a viscous liquid which is effective to retard the rotation of rotor 210 with respect to pin 222, and thereby with respect to nozzle 202.

Figure 7:
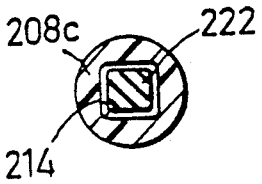

As shown particularly in FIG. 7, socket 214 formed in bridge leg 208*c* is of non-circular cross-section, and the portion of pin 222 received within this socket is also of non-circular cross-section. Thus, pin 222 is prevented from rotating with respect to nozzle 202, but is permitted to move in the axial direction towards and away from the nozzle.

Cavity 220 is formed with a central cylindrical section 220*a* serving as a bearing for the inner end 222*a* of pin 222, an outer cylindrical section 220*b* of substantially wider diameter, and a conical section 220*c* joining the two cylindrical sections 220*a*, 220*b*. Skirt 224 is formed with an inner section 224*a* fixed to the pin 222 and extending generally radially with respect to the pin, and an outer annular section 224*b* extending generally axially With respect to the pin. The inner section 224*a* is of conical configuration, corresponding to the conical configuration of cavity section 220*c*, and the outer annular section 224*b* of the skirt is of cylindrical configuration conforming to the cylindrical configuration of cavity section 220*b*. The inner conical section 224*a* of the skirt is perforated with a plurality of openings 224*c*, and the outer annular portion 224*b* of the skirt is formed with a plurality of axial slots 224*d* (FIG. 9), to permit the free flow of the viscous liquid within the cavity 220.

Cover 226 closing cavity 220 is formed with a central opening 226*a* for freely receiving pin 222. The outer circumference of cover 226 is adapted to be attached with a snap-action fit to rotor 210. Rotor 210 is formed with an annular shoulder 210*c* at the upper end of the cavity 220, and with an annular rim 210*c* at its outer face. The two channel formations 210*a*, 210*b* of the rotor come to a juncture 210*c* coaxial with the jet axis 206. Cover 226 is further formed with a circular array of recesses 226*b* on its underface (FIG. 8) to define a plurality of radially-extending ribs 226*c* which engage the inner face of rotor 210 when the cover is snap-fitted thereto.

The recesses 226*b* facilitate the initial filling of cavity 220 with the viscous liquid, and also refilling whenever that may be necessary, as will be described more particularly below.

Seal 228 fixed to cover 226 is formed with a first conical section 228*a* attached to a complementary conical section 226*d* formed centrally of the cover, and with a second conical section 228*b* formed at its inner end with an annular sealing surface 228*c* in contact with the outer surface of pin 222.

The sprinkler illustrated in FIG. 5 further includes a shield 230 fixed to pin 222 and overlying cover 226 as well as a portion of the rotor 210 to which the cover is attached. Shield 230 includes an inner section 230*a* of generally disc configuration, and an outer shroud 230*b* of cylindrical configuration so as to enclose the portion of rotor 210 to which the cover 226 is attached. Both the disc section 230*a* and the outer shroud 230*b* of shield 230 are closely spaced to the cover 226 and the portion of the rotor 210 to which the cover is attached, to define a labyrinth 232 obstructing the entry of dirt between the rotor 210 and the pin 222. The confronting faces of the shield 230, cover 226, and rotor 210 may be irregularly shaped, as shown particularly in FIG. 6, to enhance the so-formed labyrinth.

The sprinkler illustrated in FIGS. 5–9 is used in the following manner:

First, the cavity 220 in rotor 210, when the rotor is removed from the sprinkler, may be filled with the viscous liquid. Pin 222, including its skirt 224, is then inserted into the cavity 220, and the cover 226 including its seal 228 is applied with a snap-fit over the outer end of the rotor 210. One end of pin 222, with the shield 230 then or previously fixed thereto, is passed through cover 226 and its seal 228 of the rotor 210, and the other end of pin 222 is received within socket 214 by bridge leg 208*c*, such that the underface of the rotor is in alignment with nozzle 202.

When the cover 226 is snapped-over the outer end of rotor 210 to close the cavity 220 within the rotor, any excess of viscous liquid within the cavity is permitted to flow out through the openings defined by the recesses 226*b* in the cover 226. Such recesses thus facilitate the initial filling of the cavity 220 with the viscous liquid, and also any refilling which may be subsequently required.

It will also be seen that the annular sealing surface 228*c* of the seal 228 is always immersed in the viscous liquid within the cavity. This is because the annular seal is at a low point in the cavity should the viscous liquid fail to completely fill the cavity. By thus assuring that the annular sealing surface 228*c* is always immersed in the viscous liquid, the sealing surface is prevented from drying out, and a low-friction seal is effected with respect to pin 222, thereby decreasing the wear on the seal and extending its useful life.

When the sprinkler is not operating, rotor 210 drops by its own weight over nozzle 202, so that socket 212 at the lower face of the rotor abstructs the entry of dirt, insects, or the like during the non-operation of the sprinkler. As soon as he sprinkler is put into operation, the pressurized water exiting from nozzle 202 impinges against the lower face of rotor 210, thereby lifting the rotor, as shown in FIG. 5. This lifting movement is permitted by the movement of pin 222 within socket 214 of the bridge leg 208*c*.

The jet discharged from nozzle 202 is divided into two streams by the two curved channels 210*a*, 210*b* in the underface of rotor 210, which streams are deflected laterally of the sprinkler. The impingement of the jet from nozzle 202 on the underface of rotor 210 also rotates the rotor, so that the two streams of water deflected laterally of the sprinkler produce a 360° wetting pattern around the sprinkler.

During this rotation of rotor 210, the viscous liquid within cavity 220, between the inner surfaces of the cavity rotating with the rotor and the surfaces of pin 222 and its skirt 224 disposed within the cavity which do not rotate with the rotor, applies a retarding force against the rotation of the rotor. This retarding force is effective to slow-down the rotation of rotor 210, and thereby to increase the range of the water distribution as compared to a sprinkler in which the rotation of the rotor is not retarded.

As described earlier, by forming the cavity 220 for the viscous liquid in the rotor 210, rather than in a part fixed to the nozzle 202, the sprinkler can be constructed of significantly smaller size than heretofore possible for the same flow rates. This compactness in the construction of the illustrated sprinkler is further enhanced by the other structural features as described above, including the provision of the skirt 224 at the inner end of pin 222 and disposed within the cavity 220. As mentioned earlier, these constructional features enable the sprinkler to be reduced in size by about 50% as compared to the previously-known viscous liquid speed-reducers, for the same flow rates.

The Embodiment of FIGS. 10 and 11

FIG. 10 illustrates a rotary sprinkler of basically the same construction as described above with respect to FIGS. 5–9, except that the two channel formations, indicated at 310*a* and 310*b* in the rotor 310, do not come to a juncture (shown at 210*e* in FIG. 5), coaxial with respect to the axis 206 of the jet, but rather come to a juncture shown at 310*e* in FIG. 10 which is eccentric with respect to the axis 306 of the jet from nozzle 302. Such a construction has been found to provide a more uniform distribution of the water around the sprinkler.

FIG. 11 illustrates a further variation wherein the rotor, therein designated 410, is formed with a single channel 410*a* impinged by the jet discharged from the nozzle 402 so as to produce a single stream of water laterally of the sprinkler and rotating with the rotation of the rotor.

In all other respects, the sprinklers illustrated in FIGS. 10 and 11 are of the same construction, and operate in the same manner, as described above with respect to FIGS. 5–9.

While the invention has been described with respect to several preferred embodiments, it will be appreciated that many other variations, modifications and applications of the invention may be made.

What is claimed is:

1. A rotary sprinkler comprising:

a nozzle outputting a jet axially thereof;

a rotor rotatably mounted with respect to the nozzle in alignment with the axial jet and having a surface formation impinged by the axial jet to deflect the jet laterally of the nozzle and to rotate the rotor;

and a retarding device having a first surface rotatable with the rotor with respect to the nozzle, a second surface non-rotatable with respect to the nozzle, and a viscous liquid between said first and second surfaces;

characterized in that said first surface of the retarding device is a cavity formed in a surface of the rotor opposite to that having said surface formation i pinged by the axial jet, and that said second surface of the retarding device is carried by a pin non-rotatably mounted with respect to said nozzle and disposed within said cavity; said cavity in the rotor being covered by a cover removably attached to the rotor and penetrated by said pin centrally of the cover.

2. The rotary sprinkler according to claim 1, wherein said cavity includes a substantially cylindrical section, and said pin includes a skirt disposed within said substantially cylindrical section of the cavity and immersed in the viscous liquid in the cavity.

3. The rotary sprinkler according to claim 2, wherein said skirt is formed with an inner section fixed to the pin and extending generally radially with respect thereto, and an outer annular section extending generally axially with respect to the pin.

4. The rotary sprinkler according to claim 3, wherein said inner section of the skirt is formed with a plurality of openings to permit the free flow of the viscous liquid therethrough

5. The rotary sprinkler according to claim 3, wherein one surface of said cavity is of conical configuration, and said inner section of the skirt is adjacent to, and of the same conical configuration as, said one surface of the cavity.

6. The rotary sprinkler according to claim 1, further including a pin-mounting member fixed to said nozzle, said pin-mounting member being formed with a socket for receiving said pin, both said latter socket and the portion of said pin received therein being of non-circular cross-section so as to prevent rotation of the pin with respect to the nozzle, but to permit movement of the pin axially of the nozzle.

7. The rotary sprinkler according to claim 1, wherein said surface formation of the rotor impinged by the axial jet is in the form of a single channel of curved configuration extending through an arc of approximately 90° so as to produce a single jet laterally of the sprinkler.

8. The rotary sprinkler according to claim 1, wherein said surface formation of the rotor impinged by the axial jet includes a plurality of channels each of curved configuration and extending through an arc of approximately 90° so as to produce a plurality of jets laterally of the sprinkler.

9. The rotary sprinkler according to claim 8, wherein said plurality of channels come to a juncture which is coaxial with respect to the axis of the axial jet.

10. The rotary sprinkler according to claim 9, wherein said plurality of channels come to a juncture which is eccentric with respect to the axis of the axial jet.

11. The rotary sprinkler according to claim 1, wherein said cover is fixed to said pin and rotatably receives the rotor.

12. The rotary sprinkler according to claim 1, wherein said cover is fixed to said rotor and rotatably receives said pin.

13. A rotary sprinkler, comprising:

a nozzle outputting a jet axially thereof;

a rotor rotatably mounted with respect to the nozzle in alignment with the axial jet and having a surface formation impinged by the axial jet to deflect the jet laterally of the nozzle and to rotate the rotor;

and a retarding device having a first surface rotatably with the rotor with respect to the nozzle, a second surface non-rotatable with respect to the nozzle, and a viscous liquid between said first and second surfaces;

said first surface of the retarding device being a cavity formed in a surface of the rotor opposite to that having said surface formation impinged by the axial jet, said second surface of the retarding device being carried by a pin non-rotatably mounted with respect to said nozzle and disposed within said cavity;

said rotor including a cover closing said cavity and formed with an opening for receiving said pin, and further including a seal having an annular sealing surface in contact with said pin to seal the cavity, said annular surface of the seal being located so as to be continuously immersed in the viscous liquid in said cavity.

14. The rotary sprinkler according to claim 13, wherein said seal includes a first section attached to said cover, and a second section formed with said annular sealing surface in contact with said pin.

15. The rotary sprinkler according to claim 8, wherein said first section of the seal is formed with a conical socket for receiving a complementary conical stem formed in said cover.

16. The rotary sprinkler according to claim 14, wherein said second section of the seal is of conical configuration and is formed with said annular sealing surface at the end thereof opposite to said first section of the seal.

17. The rotary sprinkler according to claim 14, wherein said first section of the cover is formed with a venting passageway to permit air or an excess of viscous liquid to pass therethrough.

18. The rotary sprinkler according to claim 17, wherein said first section of the cover is formed with a plurality of radially-extending ribs attachable to said rotor with a snap-fit, said ribs being angularly spaced from each other to define said venting passageway permitting air or an excess of viscous liquid to pass therethrough.

19. The rotary sprinkler according to claim 14, wherein said pin includes a shield fixed to and overlying said cover and the portion of the rotor to which the cover is attached.

20. The rotary sprinkler according to claim 19, wherein said shield includes a shroud enclosing the portion of the rotor to which the cover is attached, the inner surface of said shield and its shroud being closely spaced to the cover and the portion of the rotor to which the cover is attached to define a labyrinth obstructing the entry of dirt between the rotor and the pin.

* * * * *